United States Patent [19]

Trott

[11] 4,347,593

[45] Aug. 31, 1982

[54] PIEZOCERAMIC TUBULAR ELEMENT WITH ZERO END DISPLACEMENT

[75] Inventor: W. James Trott, Annandale, Va.

[73] Assignee: The United States of America as represented by the Secretary of the Navy, Washington, D.C.

[21] Appl. No.: 101,362

[22] Filed: Dec. 7, 1979

[51] Int. Cl.[3] ..... H04R 17/00

[52] U.S. Cl. ..... 367/159; 367/164; 310/359; 310/369

[58] Field of Search ..... 310/369, 359, 334; 367/159, 157, 164

[56] References Cited

U.S. PATENT DOCUMENTS 2,974,296 3/1961 Rosen ..... 310/359 X 4,240,003 12/1980 Larson ..... 310/334

*Primary Examiner*—Harold J. Tudor

*Attorney, Agent, or Firm*—Robert F. Beers; William T. Ellis; Melvin L. Crane

[57] ABSTRACT

A piezoelectric tubular monopole element with zero end displacement which has an omnidirectional sensitivity over the widest possible frequency range. The center section is radially or thickness-poled and the end sections are longitudinally or length-poled. The positive electrodes are connected in parallel and the negative electrodes are connected in parallel for electrical parallel output.

4 Claims, 3 Drawing Figures

PIEZOCERAMIC TUBULAR ELEMENT WITH ZERO END DISPLACEMENT

BACKGROUND OF THE INVENTION

This invention relates to hydrophones and more particularly to a hydrophone which has an omnidirectional sensitivity characteristic over the widest possible frequency range.

Heretofore hydrophones have been made with piezoelectric materials in the form of rings, cylinders, plates, etc. These have been singularly poled either radially or in the axial or circumferential direction. If a tubular element is polarized through its thickness, i.e., radially poled, the sensitivity in the axial direction falls below the sensitivity in the radial direction when the diameter of the element is more than 5% of the wavelength of the sound. For elements poled in the axial or circumferential directions, the sensitivity in the radial direction falls below the sensitivity in the axial direction in the same range of diameter-to-wavelength. It has been determined that the directional sensitivity is largely due to sensitivity of the end caps and that a tubular element will remain omnidirectional up to a diameter-to-wavelength ratio of 0.5 if (1) the end caps are insensitive or if (2) the ends of the piezoceramic element are shielded from the sound field and the length of the tubular element is 1.5 times its diameter. This invention overcomes the problems of the prior art by combining in one piezoceramic tubular element a radially poled section with an axially or circumferentially poled section by which the end caps are made motionless if the element is driven electrically or insensitive to the sound field without shielding.

SUMMARY OF THE INVENTION

A tubular piezoceramic hydrophone with zero end displacement when driven electrically or zero end sensitivity when receiving sound waves in a fluid medium. The zero end displacement and zero end sensitivity are due to radially (or thickness) poling of the center section of the tubular element while longitudinally (or length poling) each of the end sections. A proper relationship between the length of the radially poled section relative to the length of the axially poled end sections makes the circumferential expansion the same along the full length of the tubular element and reduces the total length expansion to zero. The two directions of polarization greatly reduce the gradient sensitivity and the hydrophone is omnidirectional over a wide frequency range provided the length of the tubular element is no less than 1.5 times its diameter and the thickness of the tubular element is properly related to the length of the radially poled section.

DETAILED DESCRIPTION

Figure 1:
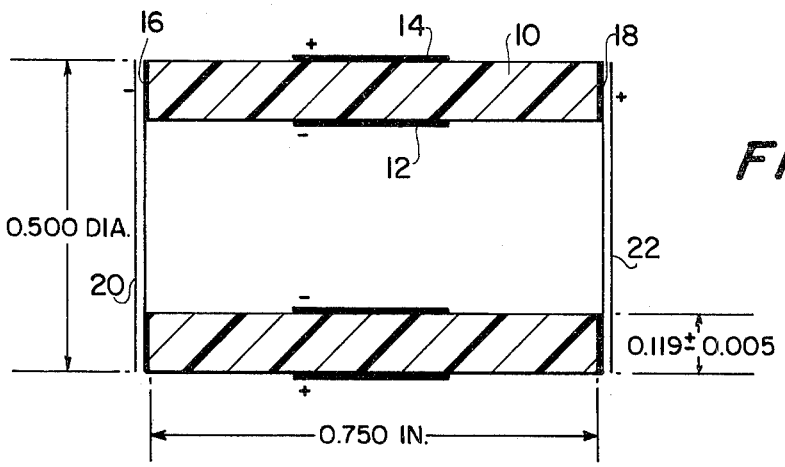
FIG. 1 is a cross-sectional view of the device.

FIG. 1 illustrates a cross-sectional view of a piezoceramic tubular element 10 which has a length $1\frac{1}{2}$ times greater than its diameter. The tubular element is provided with ring electrodes 12 and 14 on the inner and outer surfaces centered on the length of the tubular element. The end surfaces of the tubular element are provided with electrodes 16 and 18 and the ends of the tubular element are closed by rigid insulator end caps 20 and 22 made from material such as glass or ceramic. The ring and end electrodes are connected electrically in parallel for electrical parallel output. The inner confines of the tubular element is filled with air at atmospheric pressure.

Figure 2:
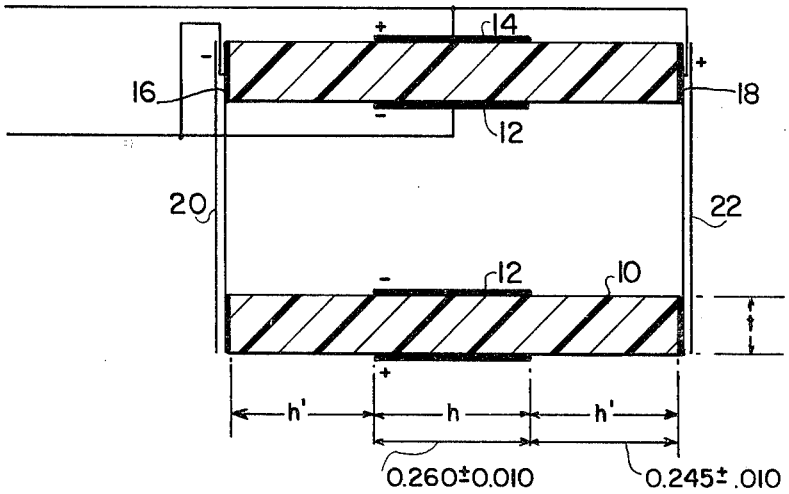
FIG. 2 is a cross-sectional view which shows the electrical connections.
Figure 3:
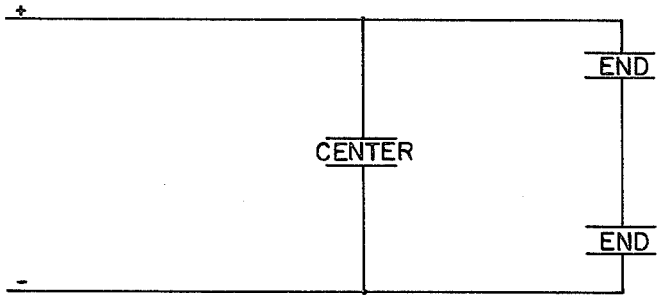
FIG. 3 illustrates the capacitive effect of the electrical arrangement.

FIG. 2 illustrates the electrical connections to the electrodes. As shown, the inner negative electrode is electrically connected to one end electrode and the outer positive electrode is connected to the other end electrode. Therefore the electrodes are connected in parallel electrically. FIG. 3 illustrates the capacitive effect of the electrodes.

With the electrodes placed as shown, the center section of the piezoceramic element is radially or thickness-poled and the end sections are longitudinally or length-poled. This invention relates to the frequency range below the first resonance of the piezoceramic tubular element. If the center, radially poled section is driven electrically, the circumference and length expand as the thickness shrinks. If the end, axially poled sections are driven electrically, the circumference and thickness expand as the length shrinks. A proper relationship of the length of the radially poled section to the length of the axially poled end sections will make the circumferential expansion the same along the full length of the tubular element and reduce the total length expansion to zero, so that the end caps will be motionless. The end caps will be insensitive to the sound field without shielding. If the tubular element length is 1.5 times its diameter, the sensitivity will be omnidirectional up to the frequency where the element diameter is equal to a half-wavelength of the sound in water.

For zero end displacement of the elements, the axial velocity of the velocity of the radially poled center section must be equal and opposite to the axial velocity of the axially poled end sections. End velocity $2U_1$ (axially poled) $= -U_2$ (radially poled)

$2U_1$ (axially poled) $= j\omega d_{33}V$ $U_2$ (radially poled) $= (h/2t)j\omega d_{32}V$ where h is the length of the radially poled section, t is the thickness of the tubular element, $d_{31}$ and $d_{33}$ are piezoelectric constants, V = voltage applied when the element is driven by a source.

$j = \sqrt{-1}$, $\omega$ = angular frequency, $U_1$ is the axial velocity of each axially poled end section, and $U_2$ is the axial velocity of the radially poled center section.

The length of the radially poled section plus the two axially poled end sections is 1.5 times the outer diameter of the tubular element. FIG. 3 shows that the end sections are connected in series making the voltage applied to the end sections one-half of the voltage applied to the center section.

Thus, $$h = -t(d_{33}/d_{31})$$

and $$2h' + h = 3a$$

where h' is the length of one axially poled end section, a is the radius of the tubular element.

For equal radial displacement of the center and end sections, zero axial expansion of the element and a length-to-diameter ratio of 1.5, the element dimensions must satisfy the equation $$6a^2 - 5\,at\,(1+d_{33}/d_{31}) + t^2\,[(d_{33}/d_{31}) + (d_{33}/d_{31})^2] = 0$$

which has been determined from well known piezoceramic formulas. Since the end caps are motionless, the piezoceramic tubular element will be omnidirectional provided the diameter-to-wavelength ratio in water is not greater than 0.5. As an example, the dimensions of the device have been included on the drawing.

In fabricating the device and checking for maximum omnidirectional frequency range, the element can be assembled in a boot as a hydrophone with all four wires fed into the preamplifier housing. Axial and radial sensitivity can be measured over the frequency range $0.06 < 2a/\lambda < 0.6$ where a is the radius of the tubular element, and $\lambda$ is the wavelength of the sound in water. If the radially poled section is too sensitive, the radial sensitivity will be above the axial sensitivity. If the axially poled section is too sensitive, the axial sensitivity will be above the radial sensitivity. The sensitivity of the too-sensitive section can be lowered by the addition of a series capacitance to the high side of its electrical circuit.

It has been determined that a piezoceramic tubular element as set forth herein will have zero end displacement, if electrically driven and zero end sensitivity during receiving, due to the two directions of polarization in one piece. The element is omnidirectional over a wider frequency range than conventional single poled elements.

The device can be mounted on an insulating rod with the inner cylindrical surface shielded from the sound field and the end exposed or capped. Also, two or more devices can be closely packed axially without the interaction which would normally produce a lower resonance if the ends moved.

The device can be made with other pole configurations such as a radially poled central section and axially poled end sections or a radially poled central section and circumferentially poled end sections or the device can be electrically connected in various series and parallel combinations. Two or more units can be mounted on a common rod insulator to acoustically shield the inner cylindrical surface, units can be cemented together and capped with a disc. In this latter configuration the hydrophone preamplifier can be assembled inside the tubular element.

Obviously many modifications and variations of the present invention are possible in light of the above teachings. It is therefore to be understood that within the scope of the appended claims the invention may be practiced otherwise than as specifically described.

I claim:

1. A piezoelectric hydrophone having omnidirectional sensitivity over a wide frequency range comprising:

a tubular element of piezoceramic material having thickness t and outside radius a;

said tubular element including a central polarized section of length h, and polarized end sections;

said central polarized sections being polarized in a direction perpendicular different from that of said end sections and with said end sections polarized in the same direction;

said tubular piezoceramic element having a length which is about 1.5 times the outer diameter of the element;

central electrode means, disposed relative to said central polarized section, for sensing the voltage output of said central polarized section;

end electrode means, disposed relative to said polarized end sections, for sensing the voltage output of said polarized end sections, said end and said central electrode means being connected electrically in parallel:

whereby pressure on the ends of the end sections causes a voltage output from said central electrode means the central section which is substantially equal and opposite to the voltage output from the said end electrode means sections whereby the vector sum of these voltages obtained via the parallel connection of said electrode means is zero and the ends are insensitive to pressure thereon.

2. A piezoceramic hydrophone as claimed in claim 1 wherein:

said central polarized section is radially polarized; and said polarized end sections are longitudinally polarized, said central electrode means comprising inner and outer ring electrodes along the central polarized section, and said end electrode means comprising electrodes on the end surfaces of said tubular element.

3. A piezoceramic hydrophone as claimed in claim 2 wherein:

said tubular element is fabricated from a piezoceramic material having piezoelectric constants $d_{33}$ and $d_{31}$; and wherein the dimensions and piezoelectric constants are related so that the equations $$h = -t\,(d_{33}/d_{31}) \text{ and } 6a^2 - 5at\,(1+d_{33}/d_{31}) + t^2((d_{33}/d_{31}) + (d/_{33}/d_{31})^2) = 0$$

are satisfied.

4. A hydrophone as claimed in claim 1 in which:

said polarized section centered on its length is circumferentially polarized; and said ends are polarized radially.

* * * * *